US006680614B2

(12) United States Patent
Tekriwal et al.

(10) Patent No.: US 6,680,614 B2
(45) Date of Patent: Jan. 20, 2004

(54) SPARK TESTER FOR A GAS COOKING APPLIANCE

(75) Inventors: Prabhat Kumar Tekriwal, Cleveland, TN (US); Jimmy D. Burger, Cleveland, TN (US); James Baynham, Cleveland, TN (US)

(73) Assignee: Maytag Corporation, Newton, IA (US)

( * ) Notice: Subject to any disclaimer, the term of this patent is extended or adjusted under 35 U.S.C. 154(b) by 112 days.

(21) Appl. No.: 10/013,362

(22) Filed: Dec. 13, 2001

(65) Prior Publication Data

US 2003/0112009 A1 Jun. 19, 2003

(51) Int. Cl.[7] ..... F02P 17/00
(52) U.S. Cl. ..... 324/396; 431/14
(58) Field of Search ..... 126/39 G; 324/396, 324/99; 431/13, 14

(56) References Cited

U.S. PATENT DOCUMENTS

| | | | | |
|---|---|---|---|---|
| 3,828,246 A | | 8/1974 | Maynard | |
| 4,160,203 A | * | 7/1979 | Volk | 324/396 |
| 4,434,402 A | | 2/1984 | Lane | |
| 4,626,196 A | * | 12/1986 | Stohrer, Jr. | 431/264 |
| 4,972,152 A | | 11/1990 | Finn | |
| 5,106,293 A | | 4/1992 | Hawkins | |
| 5,523,691 A | | 6/1996 | Frus | |
| 5,633,591 A | | 5/1997 | Childress et al. | |
| 5,721,385 A | | 2/1998 | Charmer | |
| 5,777,216 A | | 7/1998 | Van Duyne et al. | |
| 5,961,311 A | * | 10/1999 | Moore, Jr. | 431/6 |
| 6,039,040 A | * | 3/2000 | Thumfart et al. | 126/39 G |

FOREIGN PATENT DOCUMENTS

| | | |
|---|---|---|
| JP | 62-17373 | 1/1987 |

* cited by examiner

*Primary Examiner*—N. Le
*Assistant Examiner*—Walter Benson
(74) *Attorney, Agent, or Firm*—Diederiks & Whitelaw, PLC

(57) ABSTRACT

A portable spark tester for a gas cooking appliance includes a housing having a non-conductive base assembly, and a plurality of electrical conductive cables each having a first end adapted to be attached to an ignition wire for a respective gas burner of the appliance, and a second end which is secured within the housing at a position spaced from a central electrode. This spaced relationship defines a spark gap across which an electrical charge can jump. In use, the spark tester provides a technician with the ability to correctly identify certain non-functioning components of a spark ignition system of the gas appliance.

20 Claims, 4 Drawing Sheets

SPARK TESTER FOR A GAS COOKING APPLIANCE

BACKGROUND OF THE INVENTION

1. Field of Invention

The present invention pertains to the art of gas cooking appliances and, more particularly, to an apparatus for testing for the presence of a spark provided to ignite a gas burner of a gas cooking appliance.

2. Discussion of Prior Art

The operation of gas appliances is known in the art, including the incorporation of a spark module and an electronic igniter which are adapted to provide a spark to a gas burner. Correspondingly, problems associated with spark ignition systems, including diagnosing malfunctioning spark modules and electronic igniters, are also well known. As with most electrical devices, the spark ignition system can wear out and fail over time. Field technicians face the problem of isolating the failed components from the system. Without proper testing equipment, the technician can find himself replacing functioning components. Mainly due to time and other cost constraints, service technicians, when on an ignition related service call, will very often simply replace a spark module, in addition to any other suspected malfunctioning ignition components instead of actually determining the specific malfunctioning component on site. However, subsequent testing of the field returned spark modules has revealed that approximately 50% of the modules functioned normally and should not have been replaced. Certainly, other ignition components are also being unjustifiably replaced.

Replacing spark modules can represent a costly operation. Often the module is located in a hard-to-access portion of an appliance. The awkward location of the module results in the technician spending unnecessary time and effort which can be avoided if the module could be eliminated as a potential problem. Accordingly, a device that can test the functionality of the spark module and associated spark wires in the field would be a labor saver for the service technician and represent a significant cost savings for all concerned parties. Particularly, such a device would directly reduce the cost of service calls, and the customer or manufacturer will no longer need to bear the cost associated with unnecessary replacements. Accordingly, there exists a need for a spark tester adapted to test for the presence of a spark in a cooking appliance in order to readily isolate malfunctioning ignition components.

SUMMARY OF THE INVENTION

A portable spark tester constructed in accordance with the present invention is provided to enable a technician to conveniently field test the functionality of a cooking appliance spark ignition system, the major components of which are: burners, gas igniters, a spark module and spark wires. In accordance with a preferred embodiment, the spark tester includes a two part housing having a top portion and a base portion, as well as a plurality of electrical conductive cables having a first end adapted to attach to the terminal end of a spark wire and a second end terminating in an electrode mounted within the housing. The base portion includes a transmission zone including a plurality of spark gaps defined between a central electrode mounted to the base portion and each one of the spark wire electrodes. The central electrode may take various forms, such as a cross or an annular, disk element. The width of the gaps are generally set to an upper specification limit of a defined burner spark gap, or alternatively beyond the upper limit such as to provide for a more severe test.

In operation, the spark wire associated with each gas igniter is detached from an associated spark electrode, a respective one of the plurality of conductive cables is connected to an associated one of the spark wires, a control is operated to produce an electrical current, and the spark gaps located within the area of the central electrode are observed for the presence of electrical sparks.

Through this simple operation, a technician can isolate and test various components in order to substantially reduce the unnecessary costs associated with the replacement of properly functioning components. Accordingly, the spark tester of the present invention will provide the technician with a necessary tool to efficiently perform tests on the spark ignition system.

In any event, additional objects, features and advantages of the invention will become more readily apparent from the following detailed description of a preferred embodiment of the invention, when taken in conjunction with the drawings wherein like reference numerals refer to corresponding parts in the several views.

DETAILED DESCRIPTION OF THE INVENTION

Figure 1:
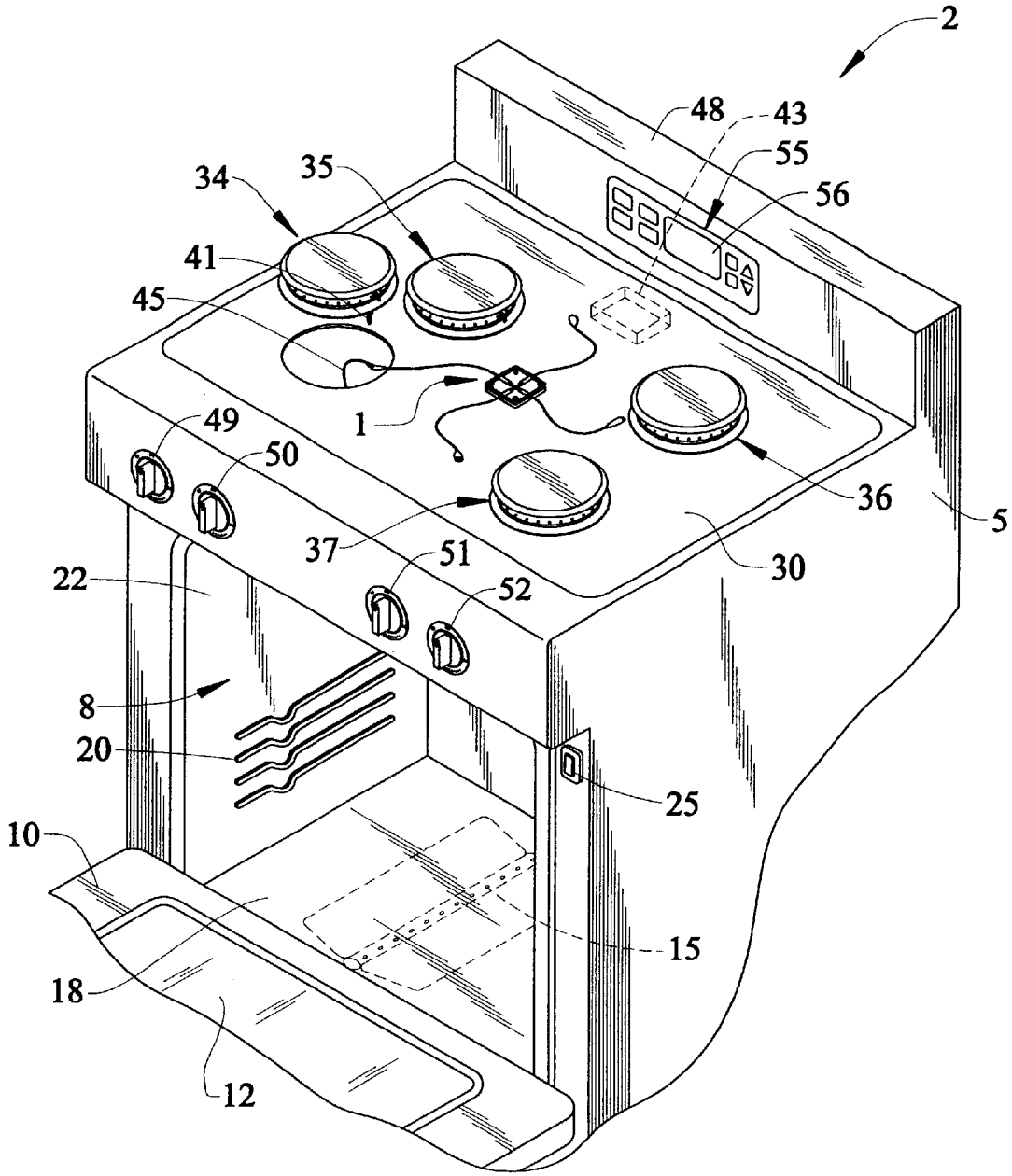
FIG. 1 is a partial perspective view of a gas range having the spark tester of the invention supported thereon.

With initial reference to FIG. 1, the portable spark tester 1 of the present invention is shown positioned upon a cooking appliance 2 which is depicted as a conventional domestic gas range of a type well known in the art. However, it should be realized that the spark tester 1 can be used in conjunction with any gas cooktop having spark igniters. Cooking appliance 2 is shown to include a cabinet 5 within which is formed an oven cavity 8. Oven cavity 8 has associated therewith a door 10 which is provided with a tempered glass viewing panel 12. Since cooking appliance 2 operates on gas, a gas burner 15 is provided beneath a bottom 18 of oven cavity 8. Furthermore, a plurality of fore-to-aft extending and vertically spaced rails 20 are provided upon opposing side walls, one of which is indicated at 22, for supporting one or more vertically adjustable racks (not shown) within oven cavity 8. For the sake of completeness, cooking appliance 2 is shown to be provided with a switch 25 that is adapted to be engaged by door 10 in order to activate a light (not shown) used to illuminate oven cavity 8 upon opening of door 10. As should be readily apparent, the structure of cooking appliance 2 described to this point is widely known in the art and does not form part of the present invention.

In accordance with the invention, cooking appliance 2 incorporates a cooktop 30. Mounted to cooktop 30 are a plurality of gas burners 34–37. As widely employed, a spark ignition system is incorporated into cooking appliance 2 to ignite gas burners 34–37. The actual construction of gas burners 34–37 is known in the art. In general, various different configurations could be readily employed as will become fully clear below. One preferred embodiment employs sealed gas burners as disclosed in U.S. Pat. No. 5,152,276 which is incorporated herein by reference. The major elements which constitute the spark ignition system are: spark electrodes or gas igniters 41, one of which is incorporated in each gas burner 34–37, at least one spark module 43, and a plurality electrical wires 45 electrically connecting igniters 41 to spark module 43. The arrangement and operation of the spark module 43 does not actually form part of the present invention and therefore will not be described further here. However, it should be realized that burners 34–37 are typically arranged as pairs which have an associated spark module 43. However, for the sake of simplicity, only a single spark module 43 is illustrated for use in connection with the invention.

Arranged at an upper rear portion of cooking appliance 2 is a control panel 48 which is used to establish desired cooking operations for oven cavity 8, while located along a front portion of cooking appliance 2 is a plurality of knobs 49–52 for controlling the operation of gas burners 34–37 and their respective gas igniters 41. Operation of the gas igniters 41 will be described more fully below. At this point, it should be realized that, although control knobs 49–52 are depicted as rotary type knobs, it is contemplated that other types of controllers, such as combination push-button/rotary knobs or even simply push buttons constitute effective substitutes. Control panel 48 is shown to incorporate a central control unit 55 that includes a visual display 56. Since the arrangement and operation of central control unit 55 does not form part of the present invention, it will not be discussed further here.

As known in the art, gas igniters 41 are provided on cooking appliance 2 in order to ignite a gas flow emanating from a respective gas burner 34–37. Each gas igniter 41 has a first end located adjacent to the respective gas burner 34–37 and a second end electrically connected to spark module 43 through one of the respective control knobs 49–52 by a respective electrical wire, one of which is shown at 45 for burner 34. In a preferred embodiment, partial rotation of a selected control knob 49–52 by a consumer initiates the gas flow to a respective one of gas burners 34–37 and simultaneously sends a signal to the spark module. The spark module 43 sends a corresponding electrical signal to the igniter 41 through wire 45 whereby a spark is developed between a terminal end of igniter 41 and an adjacent portion of the gas burner 34–37 to ignite a flowing gas. The selected control knob 49–52 is then rotated further to control the intensity of a created flame. Another potential control knob ignition embodiment is fully described in pending U.S. patent application Ser. No. 09/655,856 filed Sep. 6, 2000 which is incorporated herein by reference. In any event, the exact operation of the spark ignition system for cooking appliance 2 as described to this point is known in the art and does not form part of the present invention. Instead, this basic description is simply provided for the sake of completeness.

Figure 2:
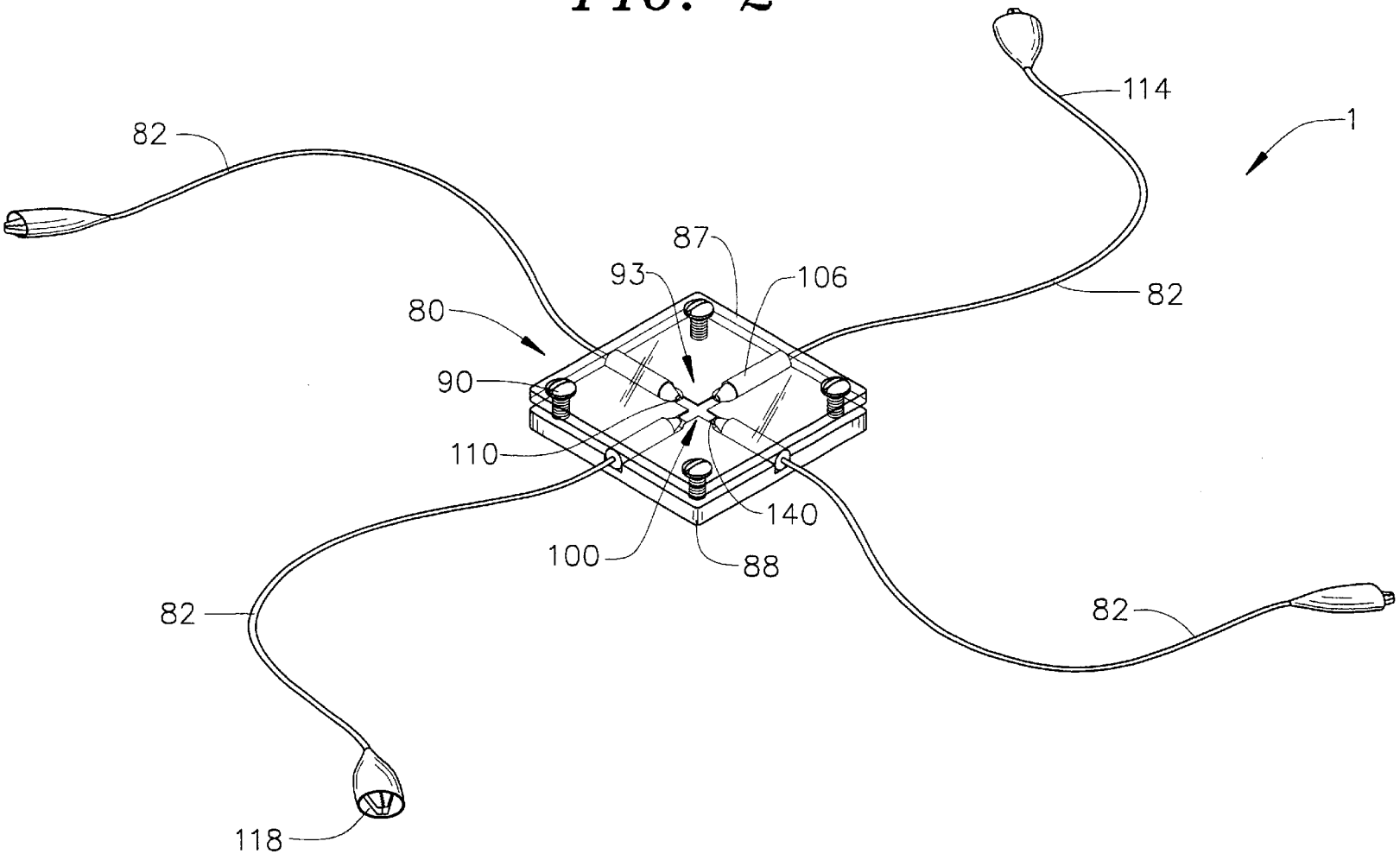
FIG. 2 is a perspective view of a spark tester constructed in accordance with a first embodiment of the invention.
Figure 3:
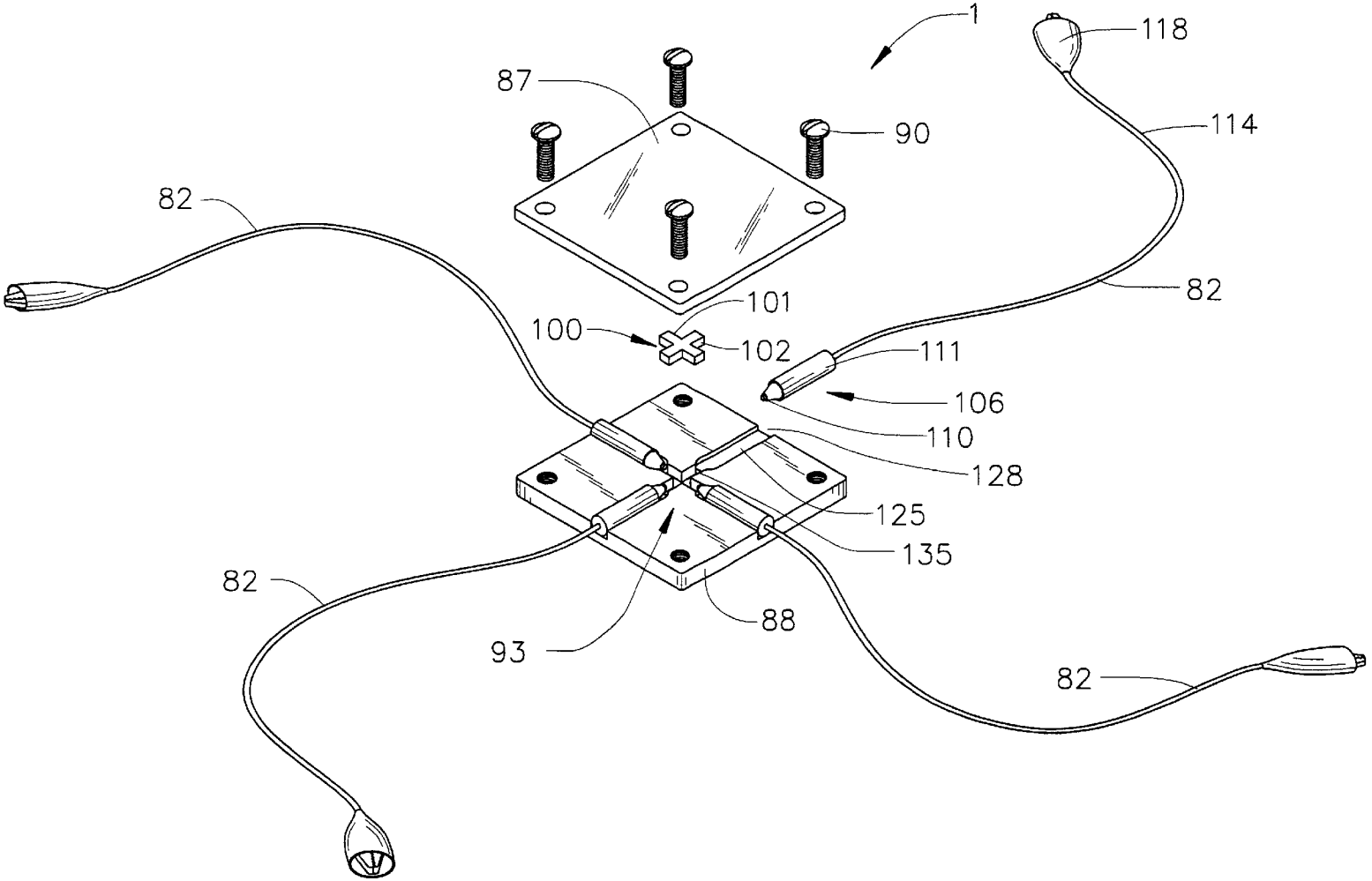
FIG. 3 is an exploded view of the spark tester of FIG. 2.

Reference will now be made to FIGS. 2–3 in describing a preferred embodiment of spark tester 1. As shown, spark tester 1 includes an electrical non-conductive housing 80 and a plurality of electrical conductive, externally insulated cables 82. Housing 80 is shown to include a clear top section 87 removably secured to a base section 88, such as through a plurality of fasteners 90. Formed in a central portion of base section 88 is a transmission zone 93 having an electrode 100 defined by a pair of criss-crossing metallic elements 101,102.

Each electrical cable 82 includes a first end 106 terminating in an electrode 110, and a second end 114 terminating in an insulated clamp 118, such as an alligator clip, adapted to be attached to a respective wire 45. Electrode 110 is an electrical conductive, metal element which is covered by an insulating sleeve portion 111 having an opening at one end which exposes a tip of the electrical conductive electrode 110 at a position spaced from electrode 100 within transmission zone 93.

The surface of base section 88 further includes a plurality of grooves 125 arranged in a spaced relationship from each other. Each groove 125 includes a first end 128 having a first cross section adapted to receive electrode 110, and a second end 135 having a second cross-section which is smaller than the first cross section. First end 128 of each groove 125 extends from an outer peripheral edge of base section 88 to adjacent second end 135 which terminates at transmission zone 93. With this arrangement, each electrode 110 is seated in a respective groove 125 with each electrode 110 being adjustably spaced from a respective element 101, 102 of electrode 100 thereby creating a plurality of spark gaps 140 between electrodes 100 and 110. Electrodes 110 are maintained in a desired spaced relationship by a clamping engagement of cover 87 which forces insulated portions 111 into grooves 125 upon tightening fasteners 90. Prior to assembly, each electrode 110 is placed at a prescribed distance from electrode 100. Once in place, cover 87 is positioned above base 88 and fasteners 90 are operated to cause cover 87 to engage base 88 with insulated portions 111 clamped therebetween.

Reference will now be made to FIGS. 1–3 in describing a preferred method of use of spark tester 1. Once a technician ascertains that a check of the spark ignition system is warranted, and after turning off the gas supply, spark tester 1 is connected to the appliance. Initially, spark wires 45 are disconnected from burners 34–37. Cables 82 are then positioned such that insulated spring clamps 118 are adjacent to respective spark wires 45 and a connection is made attaching each clamp 118 to the terminal end of a respective wire 45. At this point, a selected one of control knobs 49–52 is operated, thereby creating a path for current to flow to spark tester 1. An ignition period of generally between 20–30 seconds is established, during which time transmission zone 93 is observed, through transparent top section 87 of housing 80, for the presence of a spark jumping a respective gap 140.

Sparks generated in transmission zone 93 are preferably observed for the presence of three criteria: number of sparks traversing the spark gap, the consistency of the sparks, and the brightness of the sparks. If the three criteria are satisfied, electrical components within the spark ignition system are functioning properly and the technician is able to focus on other potential problems within the spark ignition system. If the three criteria are not met, then the technician is provided with an indicia of an electrical problem. Accordingly, the technician can check supply voltage to the appliance, the continuity of wires 45 and, if all else is sound, replace the spark module and recheck the system.

Figure 5:
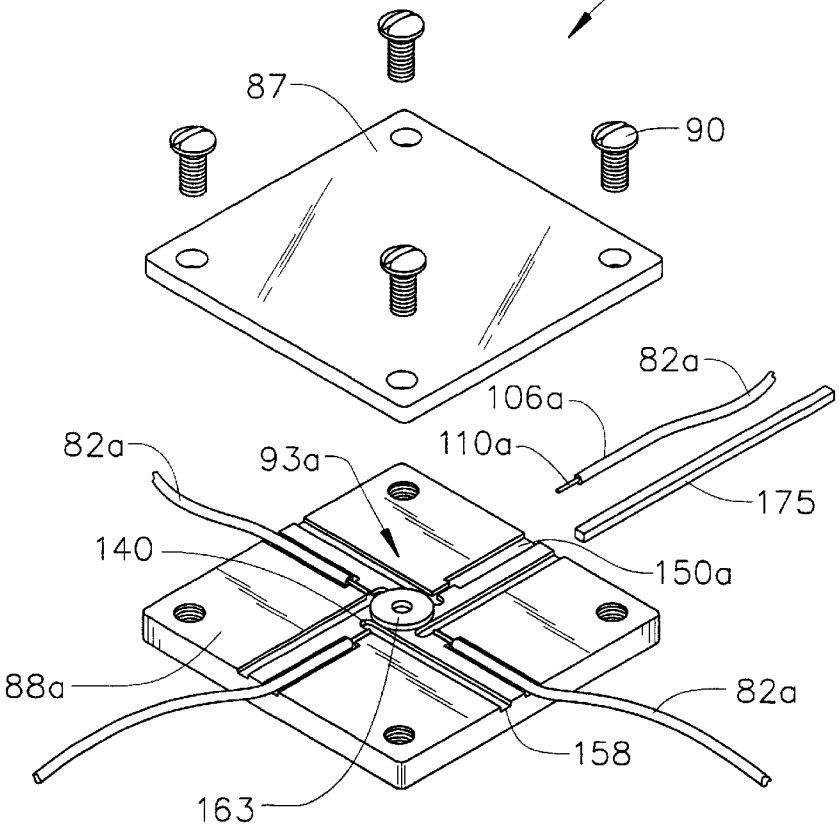
FIG. 5 is an exploded view of the spark tester of FIG. 4, while depicting an additional gap gauge for use with the spark tester.
Figure 4:
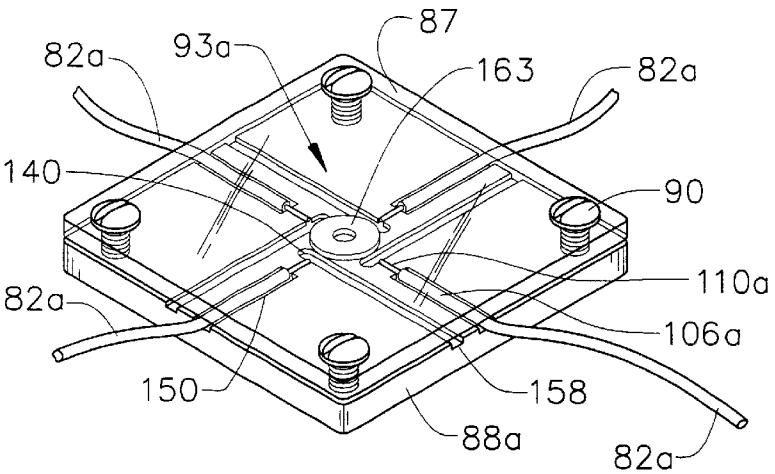
FIG. 4 is a partial perspective view of a spark tester constructed in accordance with a second embodiment of the invention.

In another preferred embodiment of the invention as illustrated in FIGS. 4 and 5, a spark tester 1*a* is shown to include a base portion 88*a* formed with a plurality of first grooves 150 extending from an outer peripheral edge of base portion 88*a* to a second end terminating at a transmission zone 93*a*. Additionally, a plurality of second grooves 158 extend substantially perpendicular from the second end of first grooves 150 and terminate in an adjacent edge section of base portion 88*a*. Transmission zone 93*a* has centrally positioned therein an annular or preferably circular disk conductive element 163.

In a manner similar to the first embodiment set forth above, one end 106*a* of each cable 82*a* is adapted to be mounted to base portion 88*a*. More specifically, end 106*a* of each cable 82*a* is set into a respective first groove 150*a* whereby a terminal electrode 110*a* of cable 82*a* partially extends into transmission zone 93*a*, while being maintained in a spaced relationship from central electrode 163 thereby forming a spark gap 140. As shown, gap 140 is preferably defined by a respective second groove 158. In contrast to the embodiment described above, electrodes 110*a* are defined by removing a portion of insulation from first end 106*a*, thereby exposing a portion of a conductor. The conductor is then coated with solder to form electrode 110*a*. While the preferred method of creating electrodes 110*a* has been described, other terminal ends could be employed to create electrode 110*a*, including the same general configuration as set forth in the previous embodiment.

An enhanced feature of this embodiment is the ability to measure spark gaps 140 in situ. Accordingly, second grooves 158 are provided to define passages within base portion 88*a* which enable a technician to measure the width of each spark gap 140. During continuous use, the tip of electrodes 110*a* can wear, resulting in an increase in spark gap 140. Accordingly, a gauge 175 is provided to measure the effective width of spark gap 140. Gauge 175 is generally defined by a bar that is inserted into groove 158 until it is positioned within the space between one of electrodes 110*a* and electrode 163. If electrodes 110*a* and 163 make contact with gauge 175, spark gap 140 is considered to be set to the desired width. Alternatively, if gauge 175 does not span gap 140, spark gap 140 may be too wide and an adjustment should be made by loosening one or more of screws 90, shifting a respective cable 82*a*, and retightening screws 90 to clamp each cable 82*a* in place. Of course, it should be recognized that gauges of various shapes and sizes can be employed to set spark gap 140 to a desired width. For instance, a larger gauge may be employed if a technician wants to set spark gap 140 to an outside tolerance range in order to determine the adequacy of the spark ignition system. Since the operation of spark tester 1*a* directly corresponds to that of spark tester 1 as set forth above, with the exception of the enhanced feature of measuring the spark gap, this overall operation will not be reiterated here.

Based on the above, it should be readily apparent that the invention provides for a spark tester of the type which permits a service technician to readily field test ignition components of a gas cooking appliance. This capability will result in an overall cost savings, particularly by reducing service call times and essentially eliminating the unnecessary replacement of properly functioning components. In any event, although preferred embodiments of the invention have been described, it should be understood that various changes and/or modifications can be made to the invention without departing from the spirit thereof. For instance, although each spark tester 1, 1*a* is preferably formed from two mating housing components which provide for clamping of the various cables in place, other housing constructions and clamping arrangements could be readily employed. In any event, the invention is only intended to be limited by the scope of the following claims.

We claim:

1. A gas cooking appliance comprising:

a cooktop;

a plurality of gas burners removably mounted to said cooktop;

a plurality of electronic igniters, each of said igniters being adapted to create a spark for an associated one of the plurality of gas burners;

a plurality of electrical conductive wires, each of said plurality of wires being adapted to provide an electrical current to a respective one of said plurality of electronic igniters; and a portable spark tester, said spark tester including a non-conductive housing defining a transmission zone, a plurality of electrical conductive cables each having a first end adapted to be attached to a respective one of the plurality of wires and a second end terminating in an electrode secured to the housing, each of the electrodes being separated from the transmission zone by a gap, across which an electrical spark is adapted to jump when testing ignition components of the gas cooking appliance.

2. The cooking appliance as claimed in claim 1, wherein said housing constitutes a two part module having first and second portions which are detachably interconnected.

3. The cooking appliance as claimed in claim 2, wherein the second end of each of the plurality of cables is clamped between the first and second portions to secure the cables to the housing.

4. The gas cooking appliance as claimed in claim 1, further comprising: a central electrode positioned in the transmission zone and spaced from the second end of each of the cables by a respective said gap, wherein the electrical spark is adapted to jump between the second end and the central electrode.

5. The gas cooking appliance as claimed in claim 4, wherein the central electrode comprises criss-crossing electrical conductive elements mounted within the transmission zone.

6. The gas cooking appliance as claimed in claim 4, wherein the central electrode comprises an electrical conductive element in the form of a disk mounted within the transmission zone.

7. The gas cooking appliance as claimed in claim 1, wherein each of said cables further includes a spring clamp provided on the first end thereof for attaching the first end to the respective one of the plurality of wires.

8. The gas cooking appliance as claimed in claim 1, further comprising:

a passage extending within the housing and leading to the gap; and a gauge adapted to be positioned in the passage to measure the width of the gap.

9. The gas cooking appliance as claimed in claim 8, wherein the passage extends within the housing generally perpendicular to the first end of the cable.

10. A portable spark tester for testing ignition components in a gas cooking appliance having a plurality of gas burners removably mounted to a cooktop, a plurality of ignitors for creating a spark for an associated one of the gas burners, and a plurality of electrical conductive wires for providing current to a respective one of the plurality of ignitors comprising:

a non-conductive housing defining a transmission zone; and a plurality of electrical conductive cables each having a first end adapted to be attached to a respective one of the plurality of electrical conductive wires and a second end terminating in an electrode secured to the housing, each of the electrodes being separated from the transmission zone by a gap, across which an electrical spark is adapted to jump, when testing ignition components of the gas cooking appliance.

11. The spark tester as claimed in claim 10, wherein said housing constitutes a two part module having first and second portions which are detachably interconnected.

12. The spark tester as claimed in claim 11, wherein the second end of each of the plurality of cables is clamped between the first and second portions to secure the cables to the housing.

13. The spark tester as claimed in claim 10, further comprising:

a central electrode positioned in the transmission zone and spaced from the second end of each of the cables by a respective said gap, wherein the electrical spark is adapted to jump between the second end and the central electrode.

14. The spark tester as claimed in claim 13, wherein the central electrode comprises criss-crossing electrical conductive elements mounted within the transmission zone.

15. The spark tester as claimed in claim 13, wherein the central electrode comprises an electrical conductive element in the form of a disk mounted within the transmission zone.

16. The spark tester as claimed in claim 10, wherein each of said cables further includes a spring clamp provided on the first end thereof for attaching the first end to the respective one of the plurality of wires.

17. The spark tester as claimed in claim 10, further comprising:

a passage extending within the housing and leading to the gap; and a gauge adapted to be positioned in the passage to measure the width of the gap.

18. The spark tester as claimed in claim 17, wherein the passage extends within the housing generally perpendicular to the first end of the cable.

19. A method of checking a spark ignition system in a gas cooking appliance having a cooktop supporting a plurality of gas burners adapted to be actuated through respective control members comprising:

disconnecting the plurality of gas burners from the cooktop to expose a plurality of electronic igniters of the gas burners;

disconnecting a plurality of conductive wires connected to the plurality of electronic igniters;

interconnecting the plurality of conductive wires to a spark tester;

operating at least one of the control members in order to send an electrical current through a respective said conductive wire; and viewing the spark tester for an indication of a potential fault in the spark ignition system.

20. The method of claim 19, further comprising:

ascertaining whether a spark is created in the spark tester; and establishing the existence of a fault in the spark ignition system when no spark is developed.

* * * * *